US005157791A

United States Patent [19]

Woodson et al.

[11] Patent Number: 5,157,791

[45] Date of Patent: Oct. 27, 1992

[54] SOCK HAVING KNITTED-IN CARRY-ALL COMPARTMENT AND METHOD OF MAKING THEREOF

[75] Inventors: Roger D. Woodson, Danville; Dallas G. Collie, Dry Fork, both of Va.

[73] Assignee: Durham Hosiery Mills, Inc., Danville, Va.

[21] Appl. No.: 669,081

[22] Filed: Mar. 12, 1991

[51] Int. Cl.[5] ..... A41B 11/00

[52] U.S. Cl. ..... 2/239; 2/247

[58] Field of Search ..... 2/239, 247, 250, 252, 2/254, 242, 248, 249, 251, 253, 61

[56] References Cited

U.S. PATENT DOCUMENTS

| | | | |
|---|---|---|---|
| 767,381 | 8/1904 | Brown | 2/239 |
| 1.117,591 | 11/1914 | Morningstar | 2/239 |
| 4,038,699 | 8/1977 | Burn | 2/239 |
| 4.445,223 | 5/1984 | Rubin | 2/239 |
| 4.961,235 | 10/1990 | Williger | 2/239 |
| 5.027.440 | 7/1991 | Morris et al. | 2/239 |

FOREIGN PATENT DOCUMENTS

| | | | |
|---|---|---|---|
| 2743741 | 9/1977 | Fed. Rep. of Germany | 2/239 |
| 7301802 | 8/1974 | France | 2/239 |
| 2364626 | 9/1976 | France | 2/239 |
| 2344238 | 12/1976 | France | 2/239 |
| 2635952 | 3/1990 | France | 2/239 |

*Primary Examiner*—Werner H. Schroeder
*Assistant Examiner*—Amy Brooke Varatta
*Attorney, Agent, or Firm*—Wegner, Cantor, Mueller & Player

[57] ABSTRACT

A sock includes a foot portion and a knitted-in storage area including an inner locking cuff layer which extends upwardly further than an outer storage compartment layer. Items may be stored between the inner and outer layers, and then the locking cuff is cuffed over the outer layer so as to lock the items within the storage compartment. A method of making and the improved machine therefor are also described.

5 Claims, 3 Drawing Sheets

SOCK HAVING KNITTED-IN CARRY-ALL COMPARTMENT AND METHOD OF MAKING THEREOF

FIELD OF THE INVENTION

The present invention is directed to a sock having a knitted-in carry-all compartment and, more particularly, to a sock having a locking cuff which, when folded over a storage compartment, serves to lock items in the storage compartment. A method of making such a sock is also disclosed.

BACKGROUND OF THE INVENTION

Athletes, particularly joggers, tennis players and the like, often encounter the problem that their sportsclothes do not have any pockets in which to carry necessary items, such as house and/or car keys. Moreover, the problem is not limited to athletic clothes. Oftentimes, jogging suits and other loungewear worn around the house are also pocketless, leaving the wearer with no convenient way to carry various small items.

One prior solution to this problem has been to provide storage areas which are sewn or glued to the side of one or both socks. This solution is not ideal, however, as it results in a clumsy, bulky pocket attached to the sock, which makes the sock uncomfortable to wear. Further, the pocket may accidently get caught on something and be ripped off, thus dumping out its contents. Moreover, the method of making these socks requires a separate gluing or sewing operation once the knitting operation is completed, which adds to the time and cost required to make the socks.

SUMMARY OF THE INVENTION

The present invention overcomes the above problem by providing a sock having a storage compartment knitted directly into the sock. In a preferred embodiment, the sock includes a foot portion and a two-layer upper portion. The inner layer extends upwardly of the outer layer, thus forming a locking cuff. Items, such as keys, may be inserted between the inner layer and the outer layer, and then the locking cuff is folded over the outer layer to securely lock the items within the storage compartment.

The sock in accordance with the present invention can be made on any circular hosiery knitting machine with dial attachment. In a preferred embodiment of the method according to the present invention, the knitting machine knits the inner locking cuff layer in the usual manner until it reaches a predetermined point for beginning the storage area. Then the cams on the main drum of the knitting machine and the kick links in the chain are arranged to begin inserting the storage area into the desired course. Initially, every other needle is raised up prior to reaching the yarn feed area. Then, as the needles approach the knitting cam, the needle divider cam is dropped in to force the needles not lifted up under the stitch cam block. This results in only every other needle being in an "active" knitting position. Concurrently, the dial bits are activated so that there will be two dial bits between each "active" needle. As the needles take on yarn, so do all of the dial bits. Once all of the dial bits have taken on yarn, they are drawn partially in to hold the stitches at the desired course. The knitting machine is then reset to resume normal knitting operations.

Normal knitting operations continue until the desired storage area length is reached. To release the held stitches and tie them into the sock after knitting the storage area, the previously "inactive" needles are interposed between the dial bits holding the yarn. As the bits are retracted, the yarn is forced off the bits by these previously inactive needles. The knitting machine is then set to resume normal knitting operations to finish out the length of the sock and to form the foot portion. Importantly, to ensure that a locking cuff is created, the length of the storage area cannot be longer than that of the inner locking cuff layer of the sock.

BRIEF DESCRIPTION OF THE DRAWINGS

These and other aspects of the invention are apparent from the attached drawings, in which.

DETAILED DESCRIPTION OF THE PREFERRED EMBODIMENTS

Figure 1:
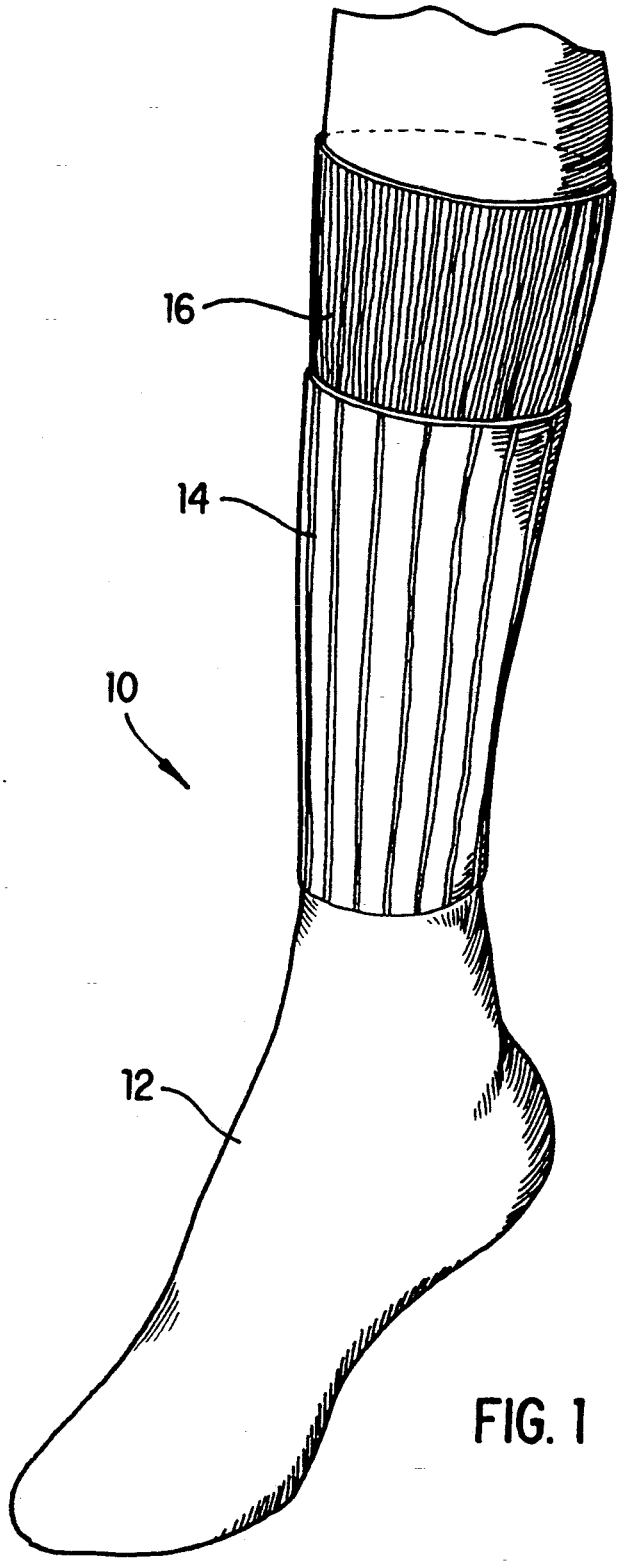
FIG. 1 is a front perspective view of a sock in accordance with a preferred embodiment of the present invention.
Figure 2:
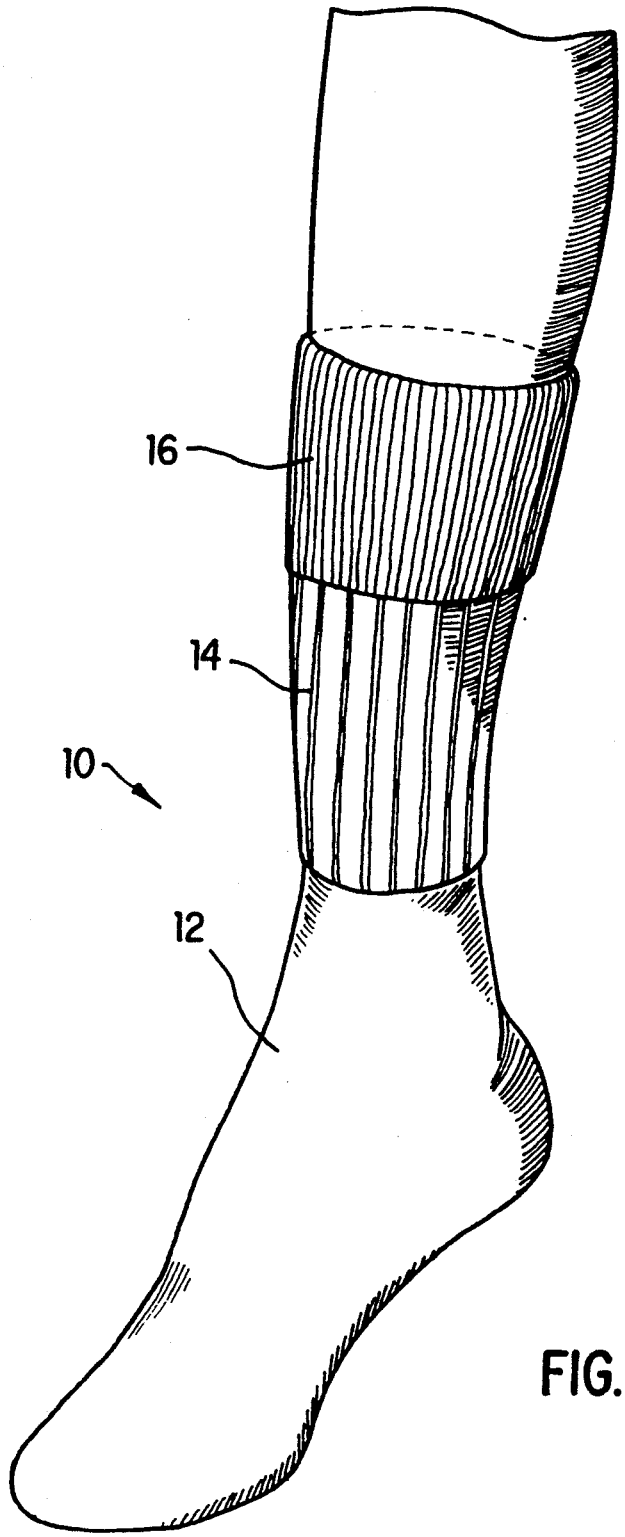
FIG. 2 is a front perspective view as in FIG. 1, but with the locking cuff folded downwardly.
Figure 3:
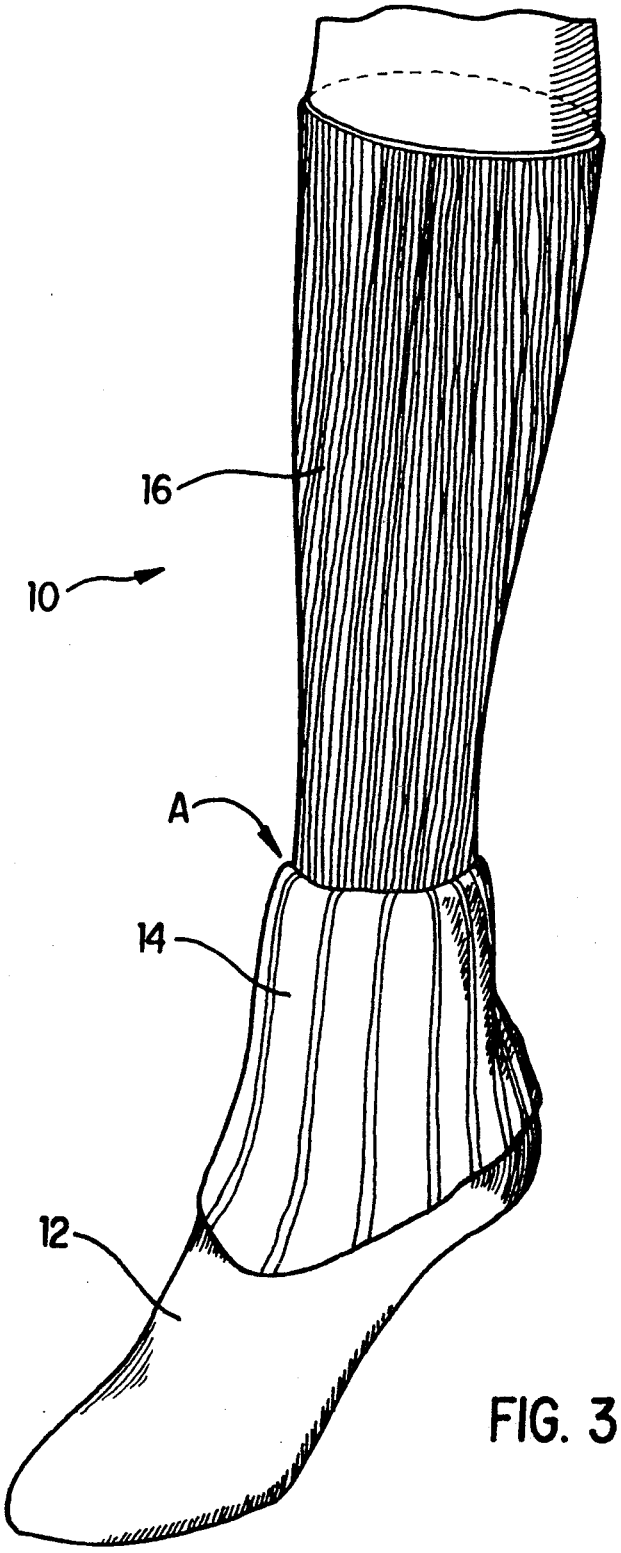
FIG. 3 is a front perspective view as in FIG. 1, but with the entire outer layer folded downwardly to show the intersection line where the storage area is tied into the sock.

A sock in accordance with a preferred embodiment of the present invention is illustrated in FIGS. 1–3, and is generally designated 10. Throughout the Figures, like numerals will be used to designate like elements.

Sock 10 includes a foot portion 12 and a two-layer storage area formed by outer storage compartment layer 14 and inner locking cuff layer 16. As shown in FIG. 3, the storage area is knitted into the foot portion at course A. It is to be understood that course A, the point at which the storage area begins, may be selected so as to be disposed anywhere on the wearer's leg from the ankle upwards, depending on the length of sock and the length of storage compartment desired.

The wearer may insert items to be stored in between the inner and outer layers shown in FIG. 1. Then the inner locking cuff layer 16 is folded downwardly to cover the top edge of the outer layer 14, as shown in FIG. 2, so that items stored within the storage compartment are locked securely therein.

A preferred method of manufacturing the sock shown in FIGS. 1–3 and the improved machine used therein is described in the following. The basic machine and its operation are conventional and known, such as the models 302 and AMY II manufactured by Speizman Industries, Inc., Charlotte, North Carolina.

In a preferred embodiment of the method according to the present invention, a circular hosiery knitting machine having 108 needles begins knitting the sock from the upper edge of the sock downwardly, i.e., knits the locking cuff layer in the usual manner until it reaches a predetermined course A for beginning the storage compartment layer. To begin knitting the storage compartment layer at course A, every other needle i.e., the "active" needles, is raised up prior to reaching the yarn feed area, by using the jack press and the $1 \times 1$ jack selector. The yarn is fed using a yarn finger.

As the needles approach the knitting cam, a divider operating cam arranged on the main drum 22, is actuated to drop needle divider cam from in to out, so as to force the needles not lifted by the jacks, i.e., the "inactive" needles, under the stitch cam block and out of the knitting position. Concurrently, a dial push-out actuator cam also arranged on the main drum is actuated to activate the dial bits. In this way, two dial bits are arranged between each active needle. As the needles take on yarn, so will the dial bits.

In the prior art basic knitting machine, the machine is geared so that two kickers or pawls move forward every four courses, i.e., every four revolutions of the cylinder. When moving forward, the chain pawl kicks the chain wheel which moves the chain. The drum pawl moves backwardly and forwardly as the chain pawl does, but does not actually kick the rack wheel until a change is desired. The drum pawl rides on the rear portion of the pawl lifter as long as plain or flat links are passing under the front portion of the pawl lifter. When a change in the sock is desired, a kick link is placed in the chain. A kick link is similar to a plain link, except that one side of the link is enlarged so that when the kick link passes under the pawl liftor, it raises the front portion of the pawl lifter which, in turn lowers the rear portion of the pawl lifter allowing the drum pawl to kick the drum rack wheel forwardly.

According to a preferred embodiment of the invention, the above-described mechanism is modified by adding an insert arranged onto a rack wheel, which puts the main drum into position so that after one course, the auxiliary kicker actuating cam actuates the auxiliary kicker. The auxiliary kicker prevents the dial bits from coming out all the way. Release of the dial push-out cam then allows the dial bits to come partially in, thus holding the stitches at the desired course. Upon release of the jack selector, jack press and needle divider cam, normal knitting operations resume.

Normal knitting operations proceed until the desired storage compartment layer length is reached. The length of the storage compartment layer must be less than the length of the locking cuff layer.

After knitting the storage compartment layer, the stitches held by the dial bits need to be released. This is accomplished by moving needle divider cam into position. Concurrently, dial push-out actuator cam disposed on the main drum causes the dial bits to extend outwardly. The dial bits come out at a point where the needles will rise on each side of the dial bits. Importantly, each previously inactive needle will now be interposed between two dial bits holding yarn, so that when dial push-in actuator cam causes the bits to retract, the yarn is forced off of the dial bits by these previously inactive needles.

The foregoing is for illustrative purposes only. Modifications can be made in accordance with the invention as defined by the appended claims.

For example, the method and improved knitting machine described above can be modified to be used on a computerized knitting machine. In this case, a computer replaces the drums, and their associated cams, the rack wheel, the auxiliary kicker and the chain, so that the action of needles and dial bits are computer-controlled.

Also, numerous knitting options exist. For example, although the preferred embodiment described above uses a cylinder-type knitting machine having 108 needles, the size of the cylinder may vary depending on the size of the customer. Also, the sock can be solid white, solid color or multi-colored, or the storage area and foot portion can be different colors, or inner layer, outer layer and foot portion all can be different colors. Stripes or other patterns may be added. Also, the sock may be made in any desired length, such as over-the-calf, mid-calf or crew length.

Although the sock described above is a tube sock, it is understood that a definite heel and toe may be created.

Furthermore, although the locking cuff is shown as having an every-other needles selection ($1\times1$) and the storage area is shown as having a three needle up-one needle down selection ($3\times1$), other suitable combination may be used to create any desired ribbing.

We claim:

1. A sock comprising:

a sock portion; and an outer layer extending from said sock portion and integrally knitted around the entire circumference of said sock portion at a lower end of said outer layer for holding stored items securely in a storage compartment formed thereby.

2. A sock as in claim 1, wherein said outer layer includes a locking cuff for said storage compartment.

3. A sock as in claim 2, wherein said locking cuff and said outer layer form a two-layer portion attached to said sock portion.

4. A sock as in claim 3, wherein said locking cuff is cuffed downwardly to cover an upper edge of said storage compartment to secure items therein.

5. A sock comprising:

a lower portion adapted to cover the foot of the wearer; and a two-layer upper portion connected to the entire circumference of said lower portion, said upper portion having an inner layer locking cuff and an outer storage compartment layer, the inner layer locking cuff being selectively foldable over said outer storage compartment layer, so that items stored within said outer storage compartment layer can be held securely therein.

* * * * *